US007305856B2

(12) United States Patent
Bolduan et al.

(10) Patent No.: US 7,305,856 B2
(45) **Date of Patent: *Dec. 11, 2007**

(54) WASHING MACHINE WITH DRYER

(75) Inventors: Edwin Bolduan, Berlin (DE); Wolfgang Proppe, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 249 days.

This patent is subject to a terminal disclaimer.

(21) Appl. No.: 10/608,497

(22) Filed: Jun. 27, 2003

(65) Prior Publication Data

US 2004/0000174 A1 Jan. 1, 2004

Related U.S. Application Data

(63) Continuation of application No. PCT/EP01/14555, filed on Dec. 11, 2001.

(30) Foreign Application Priority Data

Dec. 27, 2000 (DE) ..... 100 65 334

(51) Int. Cl.
*D06B 1/02* (2006.01)

(52) U.S. Cl. ..... 68/5 C; 68/13 R; 68/19; 68/20

(58) Field of Classification Search ..... 134/70, 134/124, 125, 126, 127, 131; 68/5 C, 5 D, 68/5 B See application file for complete search history.

(56) References Cited

U.S. PATENT DOCUMENTS 1,864,738 A * 6/1932 King ..... 68/58
1,926,977 A * 9/1933 Ermisch ..... 68/148
2,188,684 A * 1/1940 Hagopian ..... 69/23
2,328,504 A * 8/1943 Smith ..... 198/800
2,329,674 A * 9/1943 Phillips et al. ..... 202/170
2,358,507 A * 9/1944 Haberstump ..... 134/72
2,413,853 A * 1/1947 Clarke et al. ..... 134/115 R
2,443,069 A * 6/1948 Gayring ..... 68/5 C
2,632,961 A 3/1953 Robertson
2,757,530 A * 8/1956 Gould ..... 68/22 A
2,853,048 A * 9/1958 Whitbeck ..... 118/314
3,049,134 A * 8/1962 Christian et al. ..... 134/72
3,229,701 A * 1/1966 Sadwith ..... 134/72
3,445,902 A * 5/1969 Rosenberg et al. ..... 26/2 R
3,465,549 A * 9/1969 Wendt ..... 68/10
3,620,354 A * 11/1971 McMillan ..... 198/465.4
3,644,085 A * 2/1972 Beeley et al. ..... 8/150

(Continued)

FOREIGN PATENT DOCUMENTS

DE 1 610 105 11/1970

(Continued)

*Primary Examiner*—Frankie L. Stinson
(74) *Attorney, Agent, or Firm*—Russell W. Warnock; Craig J. Loest; James E. Howard

(57) ABSTRACT

A cupboard-like washing machine includes a conveyer belt for moving the item to be washed in a cycle during a drying process. The dryer can be embodied as an air circulation dryer or an air evacuation dryer. Moving the item to be washed using the conveyer belt reduced the drying time. A rinsing container that is disposed in the rear wall of the housing is used as a heat exchanger.

15 Claims, 2 Drawing Sheets

U.S. PATENT DOCUMENTS

| | | | | | |
|---|---|---|---|---|---|
| 3,732,628 | A | * | 5/1973 | Blevens et al. | 34/389 |
| 3,765,580 | A | * | 10/1973 | Wilsker et al. | 223/52 |
| 4,070,876 | A | * | 1/1978 | Thompson et al. | 68/3 R |
| 4,361,018 | A | | 11/1982 | Gallagher | |
| 4,412,435 | A | | 11/1983 | Gallagher | |
| 4,425,842 | A | | 1/1984 | Winch et al. | |
| 4,434,633 | A | | 3/1984 | Winch et al. | |
| 4,891,894 | A | * | 1/1990 | Veit | 38/66 |
| 5,502,988 | A | | 4/1996 | Shimazaki et al. | |
| 5,758,674 | A | * | 6/1998 | Taeger | 134/131 |
| 6,267,124 | B1 | * | 7/2001 | Bowden | 134/71 |

FOREIGN PATENT DOCUMENTS

| | | | |
|---|---|---|---|
| DE | 1 928 923 | | 12/1970 |
| DE | 2 014 161 | | 5/1971 |
| DE | 32 16 195 | A1 | 11/1982 |
| DE | 196 44 711 | A1 | 4/1998 |
| DE | 198 42 644 | A1 | 3/2000 |
| DE | 199 43 389 | A1 | 11/2000 |
| JP | 5-337300 | | 12/1993 |
| JP | 10-118398 | | 5/1998 |
| NL | 1005069 | | 7/1998 |

* cited by examiner

WASHING MACHINE WITH DRYER

CROSS-REFERENCE TO RELATED APPLICATION

This application is a continuation of International Application No. PCT/EP01/14555, filed Dec. 11, 2001, which designated the United States and was not published in English.

BACKGROUND OF THE INVENTION

Field of the Invention

The invention relates to a washing machine having a housing, a laundry-moving device, and a fan.

The prior art discloses washing machines of the type mentioned in the form of commercially available household washing machines with an integrated drying function. Such household washing machines, for the purpose of moving the laundry, have a laundry drum into which washing liquid is dispensed. The dirt released from the laundry is, then, transported away in a rinsing operation.

The drying of the laundry follows the washing operation. Preliminary, water removal takes place by spinning of the laundry. Thereafter, the laundry is dried, by hot air, either by the condensation principle or by the ventilation principle. If use is made of the condensation principle, it is necessary to have a heat exchanger, on which the moisture-laden air condenses. German Published, Non-Prosecuted Patent Application DE 196 44 711 A1 discloses a laundry dryer in which flow-directing bodies are disposed in a curved gas duct upstream of the heat exchanger, the bodies subdividing the gas duct in the flow direction into individual flow spaces and, thus, evening out the gas stream over the cross-section at the outlet of the gas duct and/or at the inlet of the heat exchanger. The heat exchanger is to be better utilized in this way. German Published, Non-Prosecuted Patent Application DE 199 43 389 A1 discloses a further-developed heat exchanger for household laundry dryers.

German Published, Non-Prosecuted Patent Application DE 198 42 644 A1 discloses a ventilated dryer and a circulating-air dryer operating by the condensation principle, in which the process air stream is monitored.

The prior art also discloses washing, drying, and pressing configurations for industrial laundry purposes.

U.S. Pat. No. 5,502,988 to Shimazaki et al. discloses an industrial cleaning configuration that has a conveying chain for transporting the laundry through the various washing-process steps. Furthermore, U.S. Pat. No. 4,412,435 to Gallagher discloses a continuously operating cleaning installation. The cleaning installation has a configuration for subjecting the laundry to mechanical action. A corresponding installation is also known from U.S. Pat. No. 4,361,018 to Gallagher.

Netherlands Patent Document NL 10 05 069 C2 discloses an industrial hot mangle that is intended for drying and ironing laundry and has an endless conveying belt. The conveying belt is guided, in part, along an evaporating configuration.

Japanese Patent Document JP-A-10118398 to Ishihara et al. discloses a drying, pressing and ironing configuration that is intended for washed laundry and has a belt for absorbing the moisture and rollers for transporting the laundry.

Japanese Patent Document JP-A-5337300 to Shimazaki discloses an industrial washing configuration with a conveyor that conveys the laundry through the various washing-process steps in the installation.

U.S. Pat. No. 5,439,768 discloses a conveyor that is intended for moving laundry and in the case of which the laundry that is to be conveyed is coupled to the conveying belt by fastening clips.

German Published, Non-Prosecuted Patent Application DE 32 16 195 A1, corresponding to U.S. Pat. No. 4,434,633 to Winch et al., discloses a mangle in which, by a conveying belt, the laundry is pressed against a roller to carry out preliminary water removal.

SUMMARY OF THE INVENTION

It is accordingly an object of the invention to provide a washing machine with dryer that overcomes the hereinafore-mentioned disadvantages of the heretofore-known devices of this general type and that provides an improved washing machine with integrated dryer.

With the foregoing and other objects in view, there is provided, in accordance with the invention, a washing machine, including a housing, a conveying configuration disposed in the housing and moving laundry in a circulatory path within the housing, and a fan disposed in the housing.

The invention may, advantageously, be realized both by the condensation or circulating-air principle and by the ventilation principle. Moving the already washed laundry by way of a conveying direction in the washing machine intensifies the air exchange with the laundry. As a result, the amount of time and/or energy necessary for the drying operation can be reduced correspondingly. In accordance with another feature of the invention, the conveying configuration is a conveying belt or a conveying chain. In accordance with a further feature of the invention, the conveying configuration has carry-along elements distributed along the circulatory path for receiving laundry and the carry-along elements are adapted to receive at least one of a hook and a clamping device of at least one of a laundry hanger, a clothes hanger, and a laundry net.

In accordance with an added feature of the invention, the conveying configuration keeps the laundry stationary, moves the laundry into a constant-speed circulatory path, and/or executes a reciprocating movement dependent upon a processing operation to be carried out.

In accordance with an additional feature of the invention, the washing machine, advantageously, has a cabinet-like housing. A rinsing-water container may be disposed on the rear wall of the cabinet-like housing. The rinsing-water container serves, at the same time, as a heat exchanger. As a result, water located in the rinsing-water container is preheated. Clean water that has already been preheated is, thus, available for a subsequent washing operation. As a result, energy can be saved overall.

The rinsing-water container is, preferably, realized by a double-walled configuration of the rear housing wall. This is particularly advantageous because the cabinet-like form of the housing results in a large surface area for the heat exchange between the air that is to be condensed and the condenser.

The invention makes it possible for the laundry that is to be washed to be hung on the conveying belt located in the washing machine—for example, on a hanger or a rail. The washing operation is, then, carried out on the laundry hung in this way. Completion of the washing operation is followed by the drying operation, in which the laundry is moved in an air stream by the conveying belt. The drying operation is followed, if appropriate, by a pressing and/or ironing operation, by virtue of hot air being blown into the hanging laundry. These operations can be carried out by an integrated pressing and/or ironing configuration.

Following completion of the washing, drying and, if appropriate, pressing and/or ironing operations, the laundry is, then, located in its use position, that is to say, it can be removed from the washing machine, either manually or automatically, in order to be hung on a clothes rail.

A particular advantage of the invention is that the conveying configuration of the washing machine can move the laundry into a circulatory path within the housing of the washing machine. Preferably, the circulatory path is substantially parallel to the housing wall, in particular, a side wall. Along this circulatory path, it is possible to provide different configurations for realizing the various washing-process steps. It is, thus, possible—depending on the degree of soiling—to run through the individual washing-process steps a number of times.

For example, nozzles for wetting the laundry may be disposed along one section of the circulatory path to ensure that, by virtue of the laundry being dampened, the washing powder or the washing liquid is better absorbed.

In a further section of the circulatory path, it is possible to dispose nozzles for spraying the laundry with washing liquid to soak the laundry. The dirt is, then, released by virtue of the detergent acting on the laundry.

The dirt released is, then, removed from the laundry by a rinsing operation. The rinsing operation may be realized by rinsing nozzles, which are disposed in a further section of the circulatory path and are intended for spraying rinsing water onto the laundry.

Once the laundry has been cleaned, it is advantageous to carry out a step for the preliminary removal of water from the laundry.

In accordance with yet another feature of the invention, a pair of rollers is disposed along the circulatory path in the housing is used for the preliminary removal of water from the laundry. The laundry is drawn through the pair of rollers by the conveying configuration. As a result, the rinsing water located in the laundry is squeezed out at least in part.

In accordance with yet a further feature of the invention, the preliminary water removal takes place by virtue of the laundry being pressed against an absorbent nonwoven. The laundry is, preferably, pressed against the nonwoven, in a region of the circulatory path, by a roller, and is simultaneously drawn further by the conveying configuration.

The nonwoven absorbs water from the laundry at least in a region where the roller exerts pressure, water, thus, being removed from the laundry on a preliminary basis. Preferably, the nonwoven is guided substantially parallel to movement of the laundry at least during pressing of the laundry.

In accordance with yet an added feature of the invention, the dryer has an air device for applying compressed air to the laundry. The preliminary removal of water from the laundry takes place by hot or cold compressed air. The preliminary water removal may take place both by the ventilated-dryer principle and by the condensation-dryer principle.

It is advantageously also the case that the elements that are necessary for the drying function, in particular, the warm-air nozzles, are disposed along the circulatory path described by the conveying belt. As a result, the movement of the laundry achieves a situation where the laundry is subjected, on average, uniformly to the action of warm or hot air.

In accordance with yet an additional feature of the invention, there is provided a grid, the laundry being fixed on the grid as the air device applies the compressed air.

In accordance with again another feature of the invention, there are provided supports for holding the laundry in the housing, the supports being disposed on the conveying configuration.

In accordance with again a further feature of the invention, there is provided a hot-air generating device fluidically connected to the conveying configuration and to the support and directing hot air into the laundry through the supports. To realize the pressing and/or ironing function, it is possible for compressed air to be guided into the laundry, for example, through the measures for hanging the laundry on the conveying belt, the laundry being "inflated" from the inside as a result. To produce a counter-pressure, it is simultaneously possible for the laundry to have compressed air passing over it on the outside.

With the objects of the invention in view, there is also provided a washing machine having processing operations, including a cabinet-shaped housing having a side wall and a double-walled rear housing wall, a conveying configuration disposed in the housing and moving laundry in a circulatory path within the housing substantially parallel to the side wall, the conveying configuration having carry-along elements distributed along the circulatory path for receiving laundry and conveying operations dependent upon a respective one of the processing operations to be carried out, the conveying operations including at least one of keeping the laundry stationary, moving the laundry in a constant-speed circulatory path, and executing a reciprocating movement, an absorbent nonwoven disposed in the housing and guided substantially parallel to movement of the laundry at least during pressing of the laundry, a dryer for preliminary removal of water from the laundry, the dryer being disposed in a region of the circulatory path and having a pair of rollers through which laundry is to be drawn, at least one further roller for pressing the laundry against the absorbent nonwoven, and an air device for applying compressed air to the laundry, a rinsing-water container disposed at the housing, the container being a heat exchanger and being formed in the housing by the double-walled rear housing wall, supports disposed at the conveying configuration for holding the laundry in the housing, and a fan fluidically connected to the supports and directing hot air into the laundry through the supports.

Other features that are considered as characteristic for the invention are set forth in the appended claims.

Although the invention is illustrated and described herein as embodied in a washing machine with dryer, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
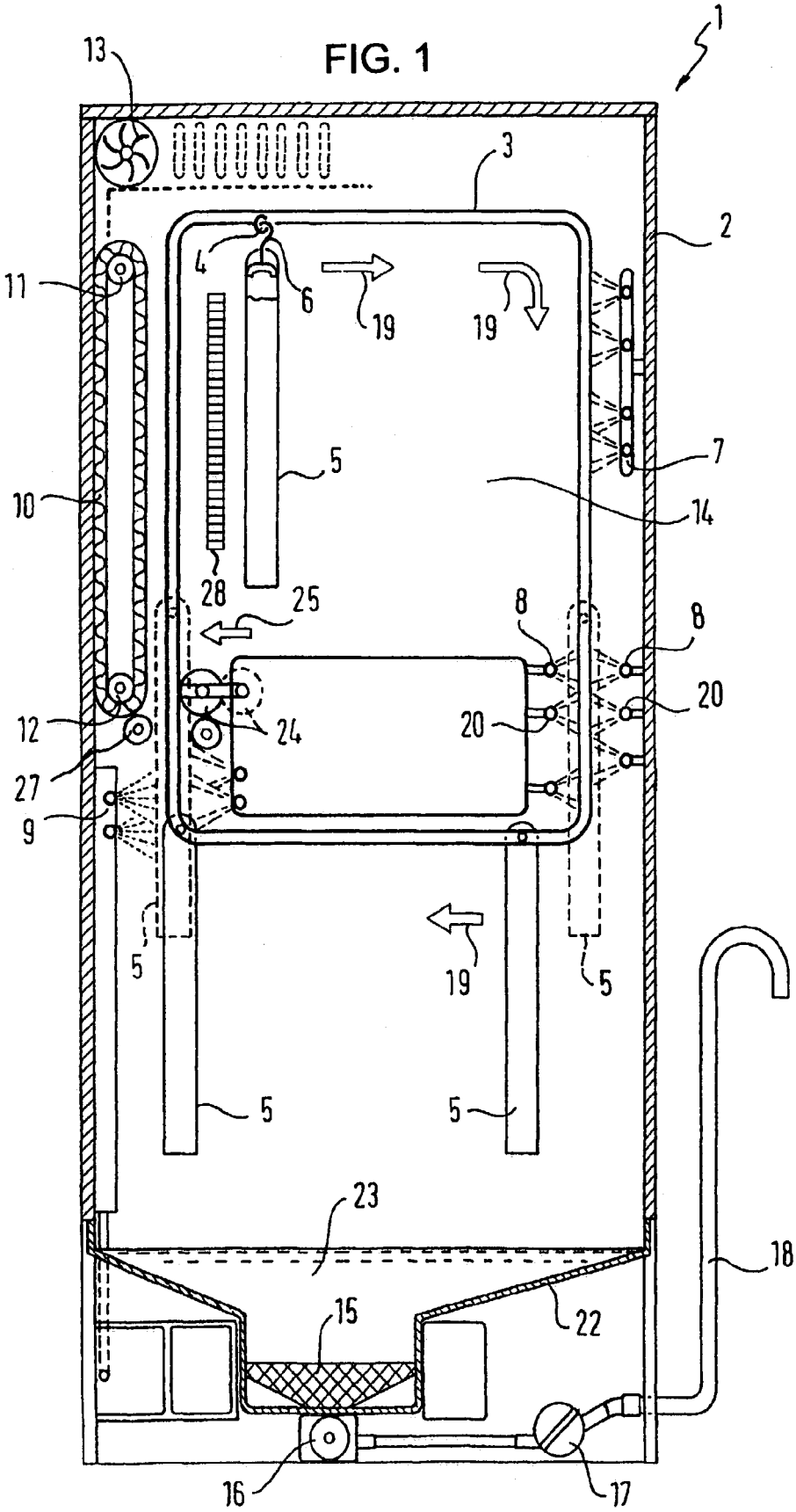
FIG. 1 is a cross-sectional view through a washing machine according to the invention parallel to a plane of a conveying belt.

Referring now to the figures of the drawings in detail and first, particularly to FIG. 1 thereof, there is shown a washing machine 1 that has a cabinet-like housing 2. The housing 2 may be, for example, up to 2 m in height. The rest of the dimensions of the washing machine 1, preferably, correspond to those of conventional household washing machines.

Located in the housing 2 is an endless conveying belt 3, which is driven, deflected, and controlled by way of a non-illustrated motor of the washing machine 1 through non-illustrated rollers or gearwheels. As an alternative, it is also possible for this conveying configuration to be realized, for example, as a conveying chain.

The conveying belt 3 has carry-along elements configured as eyelets 4. Each of the eyelets 4 serves for receiving a hook or a clip for fastening laundry on the conveying belt 3. For example, the laundry 5 may be located on a clothes hanger 6. The clothes hanger 6, then, engages, by way of its hook, in the eyelet 4. It is, thus, possible for the laundry 5 to be hung in the conveying belt 3, in a manner similar to that in a wardrobe, on hangers. Because the housing is of cabinet form and the circulatory path is guided substantially parallel to a housing wall, preferably, to the housing side wall, the acts of hanging and removing the laundry are very much facilitated.

Located on the inner side of the housing 2 are spray nozzles 7 for spraying water onto the laundry 5. Also disposed on the inner side of the housing 2, along the conveying belt 3, are cleaning nozzles 8 for spraying washing liquid onto the laundry. Located beneath the cleaning nozzles 8 are rinsing nozzles 20 for spraying rinsing water onto the laundry 5. As a result, the dirt released is rinsed out of the laundry 5.

Located on the opposite inner side of the housing 2, in a region of the conveying belt 3, is a warm-air forced-draft fan 9 for passing warm or hot air over the laundry 5. Located above the warm-air forced-draft fan 9 is an absorbent nonwoven 10, which is guided over rollers 11 and 12. At least one of the rollers 11 or 12 may be driven for the nonwoven, in its parallel region oriented directly toward the conveying belt 3, to be moved substantially synchronously with a circulatory movement of the conveying belt 3.

A fan 13 is also located in the housing 2. The fan 13 can serve for taking in air or for blowing out waste air. Located in the rear wall of the housing 2 is a heat exchanger 14, which is advantageously designed as a rinsing container. The rinsing container, thus, on one hand, has the function of storing water for the rinsing operations and, at the same time, serves as a condenser for condensing the water absorbed from the laundry 5 by way of the compressed air. The water located in the rinsing container is preheated by the heat exchange with the condensing steam. This makes it possible to reduce the energy absorption of the washing machine 1. Water is supplied to the heat exchanger 14 through channels running on the rear wall of the housing 2 or through channels running on the side walls of the housing 2. The heat exchanger 14 is filled with clean water before the drying operation begins.

In the bottom region of the housing 2, a lint filter 15 is located in a washing-liquid-collecting container 22, which serves for intercepting water. Located beneath the washing-liquid-collecting container 22 is a circulating pump 16 for wetting and/or spraying the laundry 5 through the spray nozzles 7 and/or the cleaning nozzles 8 and also a discharge pump 17 for transferring or for pumping away washing liquid through the hose 18.

A heater in the form of heating coils is located in a front region of the housing 2, beneath and/or above a door opening in the housing 2. The heating coils are not shown in FIG. 1.

To prepare for the washing operation, the laundry 5 is, first of all, hung in the conveying belt 3. If the laundry 5 is formed, for example, by shirts or blouses, then it is advantageous for these to be hung in an eyelet 4 of the conveying belt 3 in each case by way of a clothes hanger.

In the case of other types of laundry that cannot so easily be hung on a clothes hanger—for example, underwear and socks—it is advantageous to use a laundry net. One or more items of such types of laundry are placed in a laundry net that, at a top end, has a hook corresponding to the hook of the clothes hanger 6 shown in FIG. 1. By way of its hook, the laundry net can, then, be hung, like a clothes hanger 6, in an eyelet 4 of the conveying belt 3.

The detergent is supplied into the washing-liquid-collecting container 22 through a detergent-feed. This can follow, through a supply- and metering-container combination, by the dispensing-tray principle.

Once the washing program has started, the detergent dissolves in the water bath and is guided to the cleaning nozzles 8 at a given time through the circulating pump 16. For a washing program to be carried out, the conveying belt 3, in a first step, is made to circulate, to be precise corresponding to the movement direction shown by the arrows 19. The circulatory speed of the conveying belt 3, and, thus, of the laundry 5 transported by the conveying belt 3, corresponds to the respectively necessary washing-process speed.

The spray nozzles 7 wet the passing laundry 5 to dampen it, and, thus, to accelerate the absorption of detergent into the laundry 5.

In a second step, the laundry passes the cleaning nozzles 8, by which washing liquid is sprayed onto the laundry 5. The washing liquid soaks the laundry 5 and, thus, releases the dirt.

In a third step, clean water is sprayed onto the passing laundry 5 from the rinsing nozzles 20 to transport the dirt and the washing liquid away.

Sensors fitted in the housing 2 can be used to check the success of the cleaning of the laundry 5 and to measure and, if appropriate, evaluate the turbidity of the washing liquid. If the degree of cleaning is not sufficient, then the above-mentioned steps can be repeated as often as necessary.

The washing liquid and/or the rinsing water drips from the wet laundry 5 into the washing-liquid-collecting container 22 and, from there, is circulated to the cleaning nozzles 8 and/or pumped away through the discharge pump 17. In principle, it is not necessary, in the case of the washing machine 1, for the laundry 5 to be introduced into the washing liquid 23 located in the washing-liquid-collecting container 22; rather, in the exemplary embodiment shown, washing liquid is applied to the laundry 5 solely through the cleaning nozzles 8.

For improved water exchange, the laundry 5 can be moved against an abutment. Furthermore, it is possible for the water-exchange and/or the water-discharge process to be intensified and accelerated with the aid of pairs of rollers 27.

Completion of the wet phase, in which the laundry is washed, is followed by the drying phase. Once the clean-water supply to the rinsing nozzles 20 has been switched off, dry, heated compressed air for the drying process is guided onto the laundry through a compressor or the fan 13. Additional circulatory or reciprocating movement of the laundry 5 by way of the conveying belt 3 makes it possible to shorten the drying time as a result of the associated intensive air exchange with the air located in the housing 2.

Prior to the actual drying of the laundry 5, preliminary removal of water from the laundry 5 is, advantageously, carried out.

In a first embodiment, which is not shown in FIG. 1, a pair of rollers, controlled electronically by spacer sensors, moves from both sides against the laundry 5 moved by the conveying belt 3. As a result, the laundry 5 is drawn through the pair of rollers. By virtue of the contact pressure of the pair of rollers on the laundry 5 located therebetween, water is forced out of the laundry 5 and drips back into the washing-liquid-collecting container 22. Instead of a pair of rollers, it is also possible to provide a roller chain. As a result, the laundry 5, rather than being drawn through the pair of rollers, is drawn through a roller chain disposed on both sides of the laundry 5.

In the case of the preferred embodiment that is shown in FIG. 1, the laundry 5, as soon as it has reached the region of the nonwoven 10, is pressed against the nonwoven 10 by a roller 24. The roller 24 thus moves in the direction of the arrow 25, in order to press the laundry 5 against the nonwoven. At the location where the roller 24 comes into contact with the laundry 5, the laundry 5 is forced by contact pressure against the nonwoven 10. As a result, the water located in the laundry 5 is absorbed at this location, at least in part, by the nonwoven 10. At the same time, the conveying belt moves the relevant laundry 5 further along the movement seal of the arrow 19. As a result, the region in which the roller 24 comes into contact with the laundry 5, likewise, changes.

Parallel to the movement of the conveying belt 3 and of the corresponding laundry 5, the nonwoven 10, which is guided over the rollers 11 and 12, also moves further. This has the advantage that, wherever the laundry 5 is pressed against the nonwoven 10 by the roller 24, a still dry, and, thus, absorbent region of the nonwoven 10 is present. It is possible for the water absorbed in the nonwoven to be squeezed out, for example, through a further pair of non-illustrated rollers, as the water-soaked nonwoven returns on the side that is oriented directly toward the housing 2.

According to a further preferred embodiment, the preliminary water removal may take place by dry compressed air that is supplied directly to the laundry. Through the warm-air forced-draft fan, the dry air is applied to the laundry in a uniformly distributed manner. It is also possible for the laundry to be fixed, for example, between grids 28 as the compressed air is applied. The compressed air is, advantageously, supplied in a process-controlled manner in substeps.

The abovementioned steps may take place in combination or one after the other—also with repetition—to achieve an optimum cleaning effect.

Figure 2:
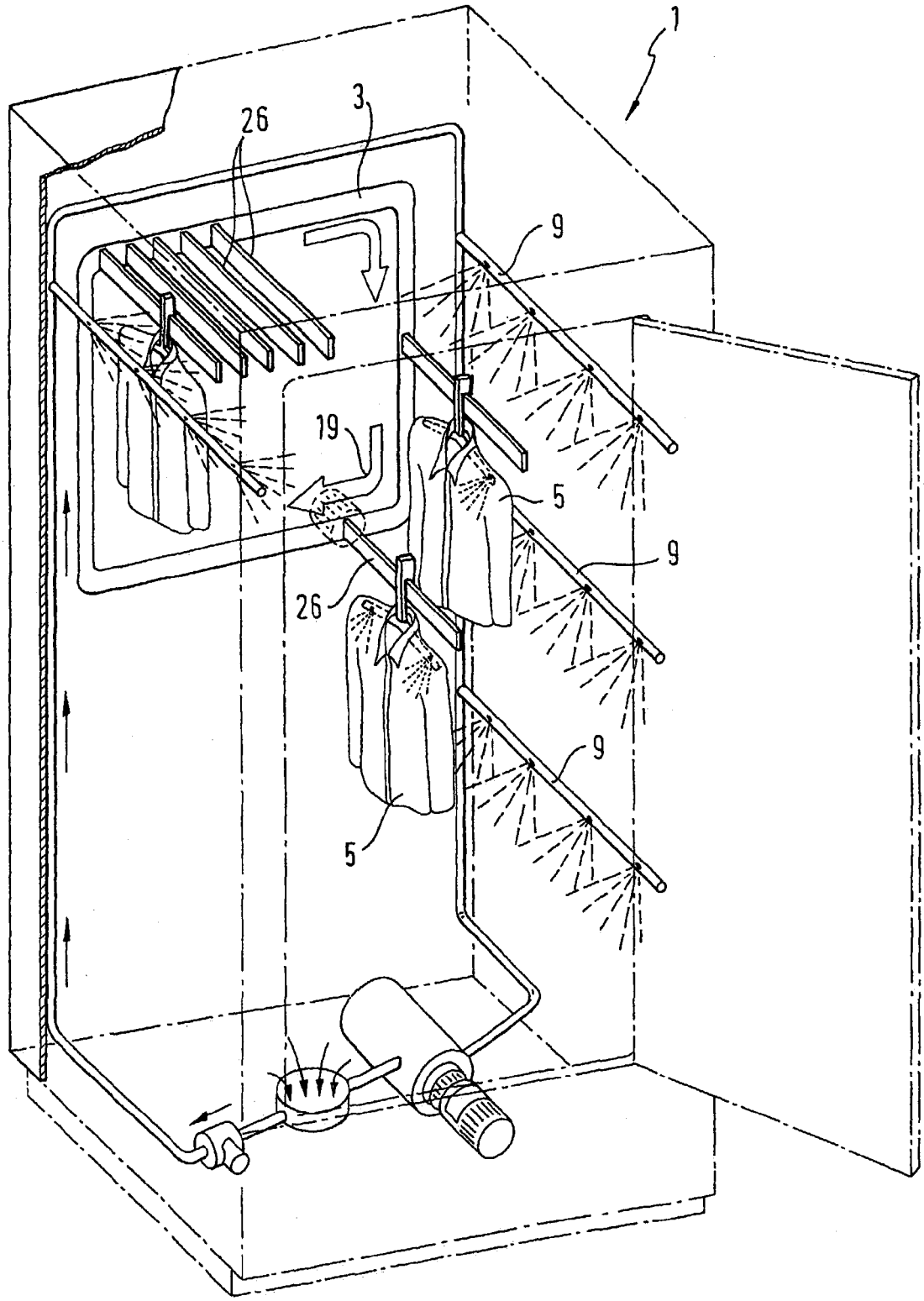
FIG. 2 is a partially hidden perspective view of a washing machine according to the invention with an ironing function.

FIG. 2 shows a further preferred embodiment of the washing machine according to the invention. For elements of FIG. 1 that correspond to the embodiment of FIG. 2, use is made of the same designations as in FIG. 1.

FIG. 2 shows a washing machine 2 with a pressing and ironing function. In the case of the exemplary embodiment shown, the washing and drying phases are followed by a pressing and/or ironing phase.

The conveying belt 3 is a two-part configuration. Only the rear part of the conveying belt 3 is illustrated in FIG. 2. Located between the two parts of the conveying belt 3 are supports 26, on which laundry 5 can be hung. These supports 26 are internally hollow for directing compressed air. Through a compressor, it is possible for hot air to be blown, through the supports 26, into the laundry 5 hanging on the supports 26.

Warm-air forced-draft fans 9 are disposed along an inner side of the housing 2. To realize the pressing and/or ironing function, hot air is blown into the laundry 5 through the supports 26. As a result, the laundry 5 is subjected internally to the pressure of hot air. At the same time, the laundry is moved past the warm-air forced-draft fans 9 in the direction of the arrow 19 by way of the movement of the conveying belt 3. As a result, the laundry 5 is also subjected externally to air pressure so that a counter-pressure is produced. This results in the desired pressing and ironing effect.

Following completion of the pressing and ironing operation, the laundry 5 is in a ready-for-use position. It can be moved mechanically, by a machine, from the washing machine 1 into a wardrobe or linen cupboard.

We claim:

1. A washing machine, comprising:

a housing;

a conveying configuration disposed in said housing and moving laundry in a circulatory path within said housing, the laundry being supported by the conveying configuration and hanging freely from the conveying configuration;

a fan disposed in said housing; and wherein said conveying configuration is operable to convey the laundry in at least three modes dependent upon a processing operation to be carried out, wherein the first mode keeps the laundry stationary, the second mode moves the laundry into a constant-speed circulatory path, and the third mode executes a reciprocating movement.

2. A washing machine, comprising:

a housing;

a conveying configuration disposed in said housing and moving laundry in a circulatory path within said housing, the laundry being supported by the conveying configuration and hanging freely from the conveying configuration;

a fan disposed in said housing;

wherein said conveying configuration is a conveying belt or a conveying chain; and a dryer for preliminary removal of water from the laundry, said dryer being disposed in a region of said circulatory path.

3. The washing machine according to claim 2, wherein:

said housing is cabinet-shaped and has a housing wall; and said circulatory path is substantially parallel to said housing wall.

4. The washing machine according to claim 3, wherein said housing wall is a side wall.

5. The washing machine according to claim 2, wherein:

said conveying configuration has carry-along elements distributed along said circulatory path for receiving laundry; and said carry-along elements are adapted to receive at least one of a hook and a clamping device of at least one of a laundry hanger, a clothes hanger, and a laundry net.

6. The washing machine according to claim 2, wherein said dryer has a pair of rollers through which laundry can be drawn.

7. The washing machine according to claim 2, further comprising:

an absorbent nonwoven disposed in said housing; and said dryer having at least one roller for pressing the laundry against said absorbent nonwoven.

8. The washing machine according to claim 7, wherein said non-woven is guided substantially parallel to movement of the laundry at least during pressing of the laundry.

9. The washing machine according to claim 2, wherein said dryer has an air device for applying compressed air to the laundry.

10. The washing machine according to claim 9, further comprising a grid, the laundry being fixed on said grid as said air device applies the compressed air.

11. The washing machine according to claim 2, further comprising supports for holding the laundry in said housing, said supports being disposed on said conveying configuration.

12. A washing machine, comprising: a housing;

a conveying configuration disposed in said housing and moving laundry in a circulatory path within said housing, the laundry being supported by the conveying configuration and hanging freely from the conveying configuration;

a fan disposed in said housing;

wherein said conveying configuration is a conveying belt or a conveying chain; and at least one of an integrated pressing configuration and an integrated ironing configuration.

13. A washing machine, comprising:

a housing;

a conveying configuration disposed in said housing and moving laundry in a circulatory path within said housing;

a fan disposed in said housing;

a rinsing-water container disposed at said housing, said container being a heat exchanger; and wherein the rinsing-water container retains water for rinsing the laundry and the heat exchanger condenses moisture removed from the laundry.

14. The washing machine according to claim 13, wherein said rinsing-water container is formed in said housing by a double-walled housing wall.

15. The washing machine according to claim 14, wherein said housing wall is a double-walled rear housing wall.

* * * * *